US006274800B1

(12) United States Patent
Gardner

(10) Patent No.: US 6,274,800 B1
(45) Date of Patent: Aug. 14, 2001

(54) CONVERTIBLE MUSICAL INSTRUMENT

(75) Inventor: Roger J. Gardner, Lomita, CA (US)

(73) Assignee: Elliot Rudell, Rancho Palos Verdes, CA (US)

( * ) Notice: Subject to any disclaimer, the term of this patent is extended or adjusted under 35 U.S.C. 154(b) by 0 days.

(21) Appl. No.: 09/638,935

(22) Filed: Aug. 15, 2000

(51) Int. Cl.[7] ..... G10H 1/32

(52) U.S. Cl. ..... 84/644; 84/743; 446/408; 446/487

(58) Field of Search ..... 84/600, 644, 670, 84/743, 746; 446/71, 81, 408, 487

(56) References Cited

U.S. PATENT DOCUMENTS

| | | | | |
|---|---|---|---|---|
| D. 255,803 | | 7/1980 | Leal | D17/2 |
| D. 300,154 | | 3/1989 | Chen | D21/64 |
| D. 306,619 | | 3/1990 | Doi | D21/150 |
| D. 306,621 | | 3/1990 | Doi | D21/150 |
| D. 310,090 | | 8/1990 | Stone et al. | D17/2 |
| 3,524,377 | | 8/1970 | Desmond | 84/267 |
| 4,088,050 | | 5/1978 | Appel | 84/267 |
| 4,575,352 | | 3/1986 | Matsuda | 446/376 |
| 5,085,119 | * | 2/1992 | Cole . | |
| 5,434,350 | * | 7/1995 | Haney et al. | 84/743 |
| 5,557,057 | * | 9/1996 | Starr . | |
| 5,596,157 | | 1/1997 | Williams | 84/170 |
| 5,691,490 | | 11/1997 | Williams | 84/170 |
| 5,785,572 | | 7/1998 | Levy et al. | 446/144 |
| 5,841,052 | * | 11/1998 | Stanton | 84/600 |

OTHER PUBLICATIONS

One Man Jam: two (2) photographs.

* cited by examiner

*Primary Examiner*—Jeffrey Donels
(74) *Attorney, Agent, or Firm*—Foley & Lardner

(57) ABSTRACT

A combination musical instrument comprising first and second instrument portions each having first and second sides and a plurality of input devices actuable by a user on one side thereof. The first and second portions are coupled to each other. In one embodiment of the invention, the first portion resembles a keyboard and the second portion resembles a guitar. When the input devices on the guitar portion are actuated, sound files stored in a microcontroller are transmitted through a speaker, producing sounds that resemble those made by a guitar. When the input devices on the keyboard portion are actuated, different sound files are transmitted by the microcontroller through the speaker, producing sounds that resemble those made a keyboard, organ, drums, xylophone or other instrument. In one embodiment of the invention, the keyboard portion is foldable about an axis, concealing the keyboard portion from view.

20 Claims, 7 Drawing Sheets

FIG.6
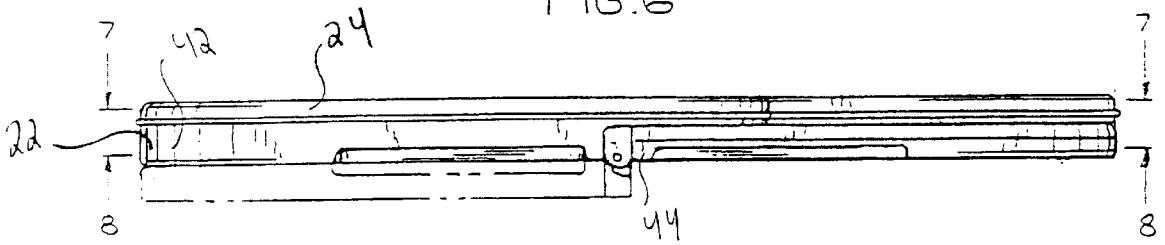
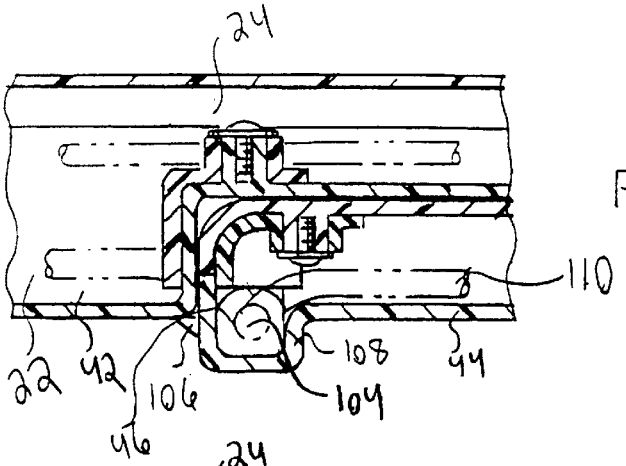
FIG.9
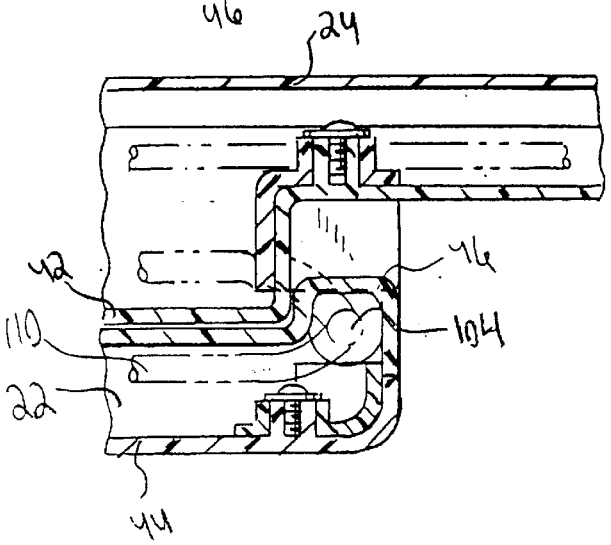
FIG.10

CONVERTIBLE MUSICAL INSTRUMENT

TECHNICAL FIELD

This invention relates generally to musical instruments. More particularly, this invention relates to toy musical instruments where the toy can be converted from one type of musical instrument to another type of musical instrument.

BACKGROUND OF THE INVENTION

Musical instruments are well known in the children's toy industry. There are a variety of children's products currently available that resemble musical instruments such as guitars, pianos, keyboards, or drums. These toys are shaped to resemble actual musical instruments in appearance and often include electrical and/or mechanical components that will produce a variety of sounds when a child or infant "plays" the instrument by pushing the buttons or keys on the instrument. Some of these toy instruments can also be configured such that the sounds produced by the toy closely corresponds to the scales of notes that are played by the actual instrument that the toy resembles.

Although musical toys are known in the toy industry, these instruments have a number of shortcomings. For example, toy instruments currently available are designed to resemble one particular instrument; e.g., there are currently available toy guitars or toy keyboards, but not combination toy guitar/keyboards. Additionally, young children enjoy using toys that are capable of "transforming" into other toys. In the case of musical instruments, however, there are no such toys currently available that transform from one musical instrument to another. This problem is compounded by the fact that, for a young child to obtain an increased level of enjoyment from the transforming toy, each of the musical instruments in the toy should be capable of functioning properly, playing different instrument sounds when actuated by the child. Such toys can become more difficult and expensive to manufacture if multiple instruments are combined. For these reasons, it is desirable to have a convertible toy instrument that can resemble multiple musical instruments in sound and shape or appearance while still being relatively inexpensive and simple to produce.

SUMMARY OF THE INVENTION

One combination musical instrument can comprise a guitar portion coupled to a keyboard portion. On the front side of both the guitar portion and the keyboard portions are a plurality of input devices that are actuable by a user. Upon the actuation of one of the input devices, one of a plurality of sounds is transmitted by a processor unit to a speaker or other audio output unit. The sounds resulting from an actuation of one of the input devices on the guitar portion resemble the sounds that would emanate from an electric, string or other type of guitar. In the case of the keyboard portion, the sounds resulting from an actuation of one of the input devices can resemble the sounds that would emanate from either a keyboard, organ, xylophone or drum set. Both the keyboard portion and the guitar portion can also include input devices that allow the user to change the types of sounds that will emanate from the instrument portions, and other input devices can cause a sequence of preprogrammed sounds to be output by the audio output unit. In one embodiment of the invention, the keyboard portion is foldable along an axis such that the entire keyboard portion is concealed from view when looking at the front face of the guitar portion of the instrument. When in the collapsed position, all of the input devices on the keyboard portion can be concealed from use and view.

Further advantages and features of the present invention will be apparent from the following specification and claims, taken in conjunction with the accompanying drawings, wherein like reference numerals refer to like parts.

BRIEF DESCRIPTION OF THE DRAWINGS

FIG. 6 is a side view of the convertible musical instrument of FIG. 1.

FIG. 9 is a sectional view of the hinged joint of the keyboard portion of the instrument, taken along line 9—9 of FIG. 7.

FIG. 10 is another sectional view of the hinged joint with the keyboard portion is in the collapsed position.

DETAILED DESCRIPTION OF THE INVENTION

Figure 1:
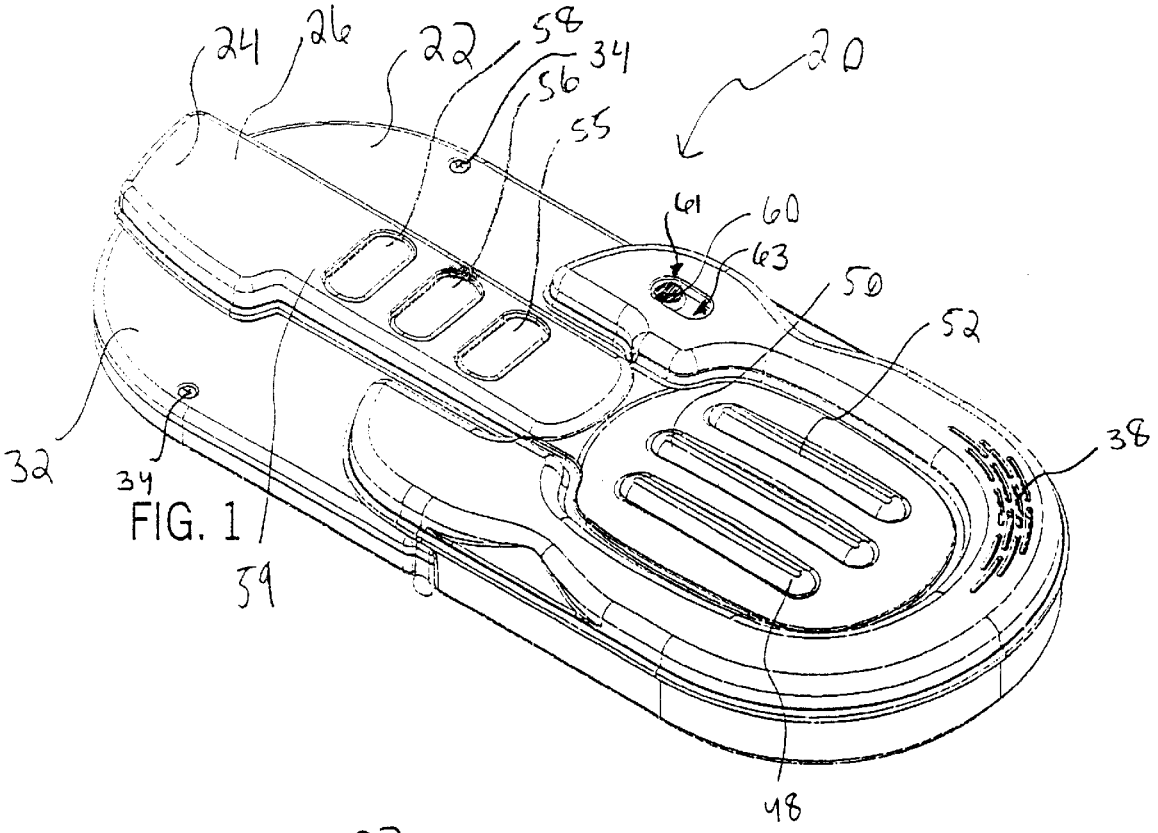
FIG. 1 is an isometric view of a convertible musical instrument.

As shown in FIGS. 1–4, a convertible musical instrument constructed in accordance with one embodiment of the invention is shown generally at 20. The convertible musical instrument 20 includes a guitar portion 24 and a keyboard portion 22. The guitar portion 24 and the keyboard portion 22 are coupled to each other. The keyboard portion 22 has front and back sides 30 and 32, respectively, and first and second ends 42 and 44, and the guitar portion 24 also has a front side 26 and a back side 28.

As can be seen in FIG. 1, the guitar portion 24 includes a plurality of buttons 48, 50 and 52 that are actuable by a user. When actuated by the user, each of these buttons 48, 50 and 52 is capable of producing one or more sounds that resemble sounds that would emanate from an actual guitar. The guitar portion 24 also includes a plurality of buttons 55, 56 and 58 located on the guitar throat 59 that are also actuable by user. As can be seen more clearly in FIG. 7, actuators 148 and 150 are located generally below buttons 48, 50 and 52; and actuators 155, 156 and 158 are located generally below buttons 55, 56 and 58. When one of the buttons 55, 56 or 58 is pressed, the corresponding actuator 155, 156 or 158 is actuated and a signal is sent to electronic circuitry inside the instrument (discussed later in detail). According to one embodiment of the invention, each button 55, 56 or 58 corresponds to one particular type of guitar, and the pressing of a particular button causes different types of guitar sounds to be played when one of the buttons 48, 50 and 52 is pressed. For example, in one embodiment of the invention, buttons 56 and 58 change the sound played by the guitar portion 24 such that the sound more closely resembles the sound from an electric guitar, while the pressing of the button 55 causes the guitar portion 24 to sound more like an acoustic, "unplugged" guitar.

In one preferred embodiment of the invention, each of the buttons 48, 50 and 52 are coupled to each other by plate 49 located inside the guitar portion 24. Regardless of which button is pressed, a sequence of notes will be played by the guitar portion 24 through the speaker 36, with the sound flowing out of a guitar speaker output 38. In an alternate embodiment, only one note at a time will be played through the speaker 36, shown in FIGS. 7–8, upon the pressing of one of the buttons 48, 50 and 52. It is also possible, in other embodiments of the invention, to have each of the buttons 48, 50 and 52 operate independently of one another, where the pressing of each button will result in the playing of a different sound. According to one embodiment of the invention, the guitar portion 24 can also have a mode switch 60 for altering the operation of the guitar portion 24. For example, when the mode switch 60 is in a first position 61, the pressing of one of the buttons 48, 50 and 52 can result in the playing of an extended sequence of notes, including the playing of an entire song. When the switch 60 is in a second position 63, the pressing of one of the buttons 48, 50 and 52 can instead result in a shortened sequence of notes or only a portion of a song. In this instance, the user would have to press the buttons 48, 50 and 52 multiple times in order for the instrument 20 to play an entire song. This will give the appearance that the user is actually "playing" the instrument 20.

Figure 2:
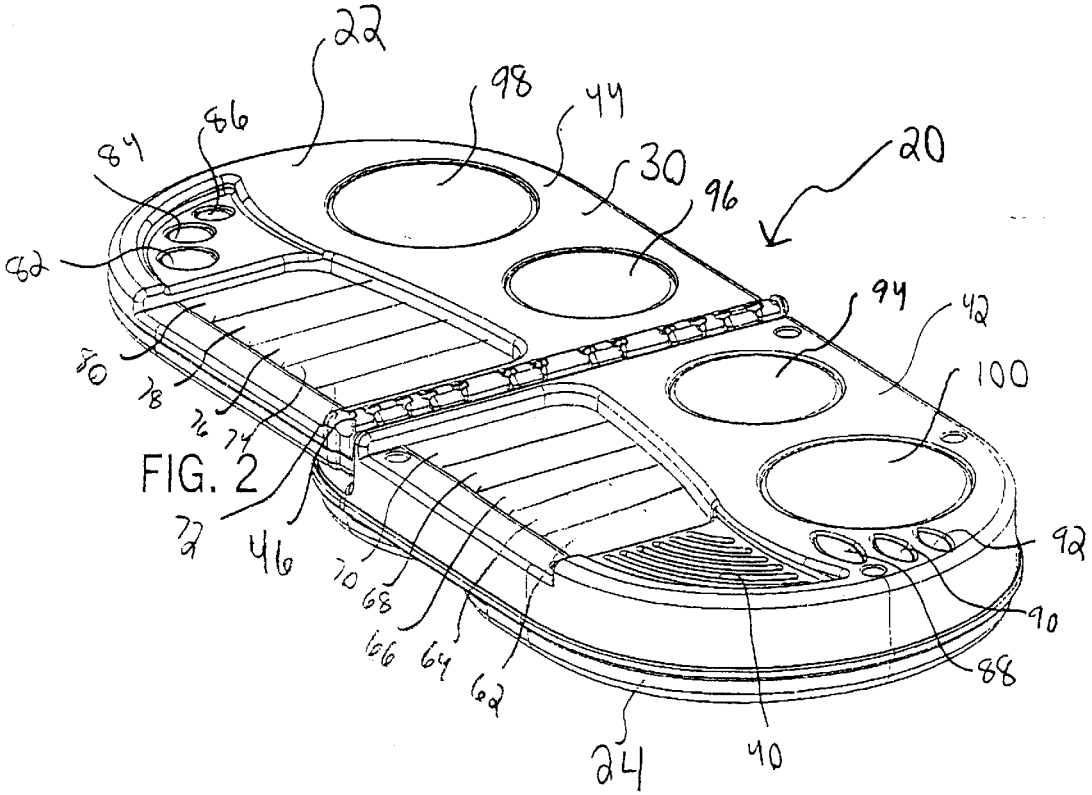
FIG. 2 is another isometric view of the instrument taken from a second direction.
Figure 3:
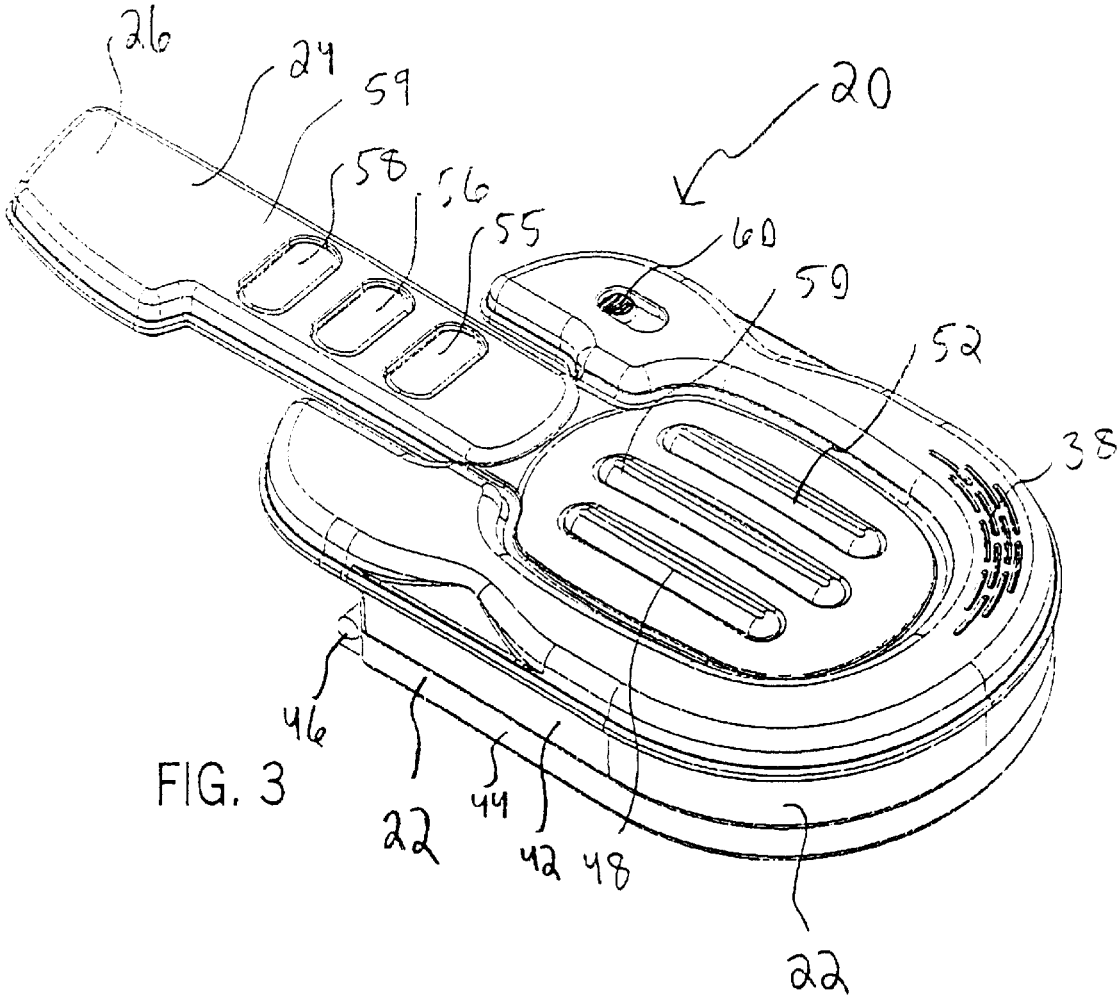
FIG. 3 is an isometric view of the convertible instrument with the keyboard portion in the fully collapsed position.
Figure 4:
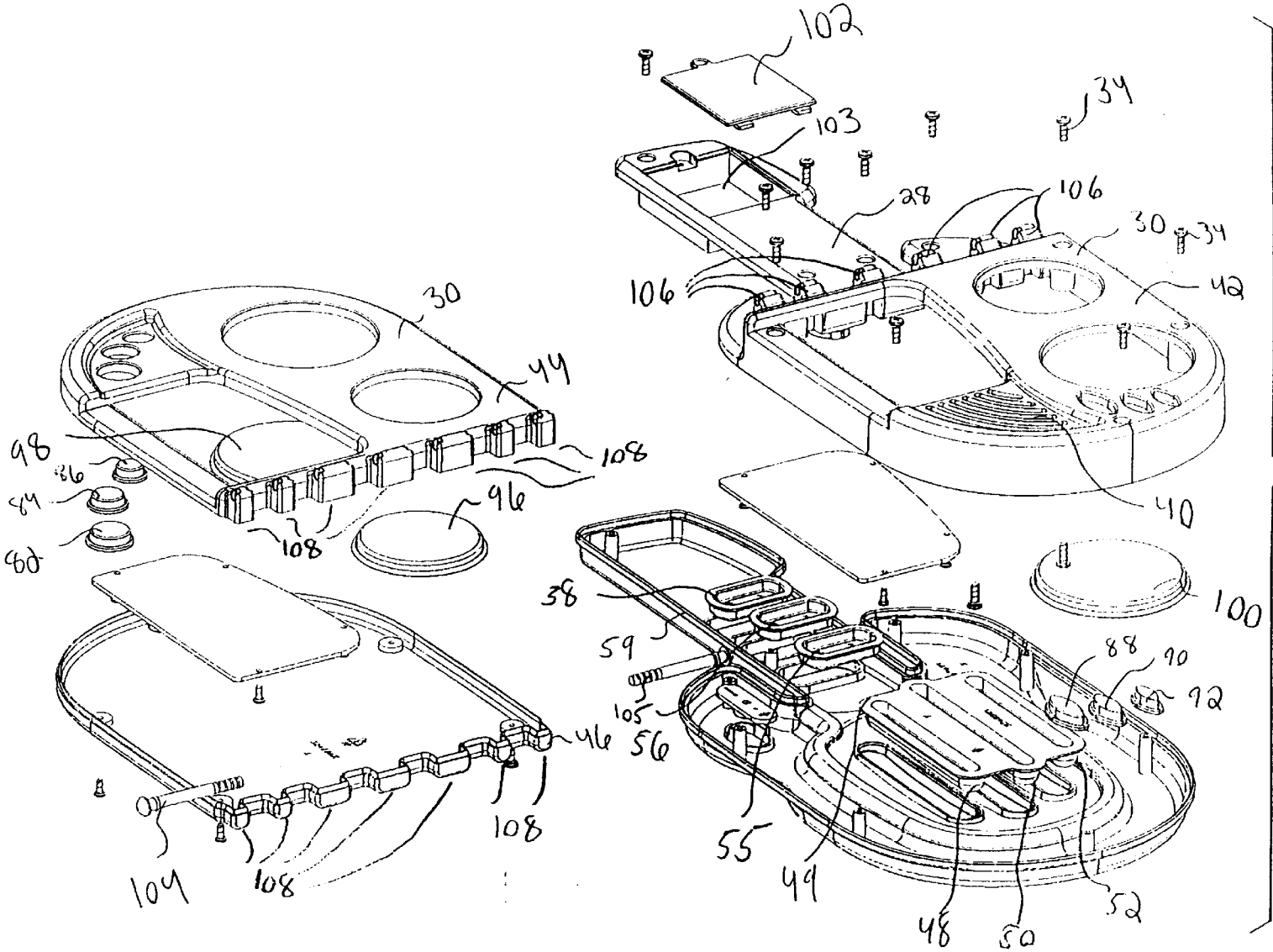
FIG. 4 is an exploded view of the instrument of FIG. 1.

As shown in FIGS. 1, 2 and 4, the keyboard portion 22 of the instrument 20 is coupled to the guitar portion 24. In one embodiment of the invention, the back side 28 of the guitar portion 24 is directly coupled to at least part of the back side 32 of the keyboard portion 22. The keyboard portion 22 includes first and second ends 42 and 44 that fold along a keyboard hinge 46, with the first end 42 remaining stationary while the second end 44 is rotated about the hinge 46. When in the folded or collapsed position, the entire keyboard portion 22 is concealed from view when a user is looking directly at the front side 26 of the guitar portion 24. (See FIG. 1) It is this folding action which makes the instrument "transformable" from one type of musical instrument to another type of musical instrument.

Figure 8:
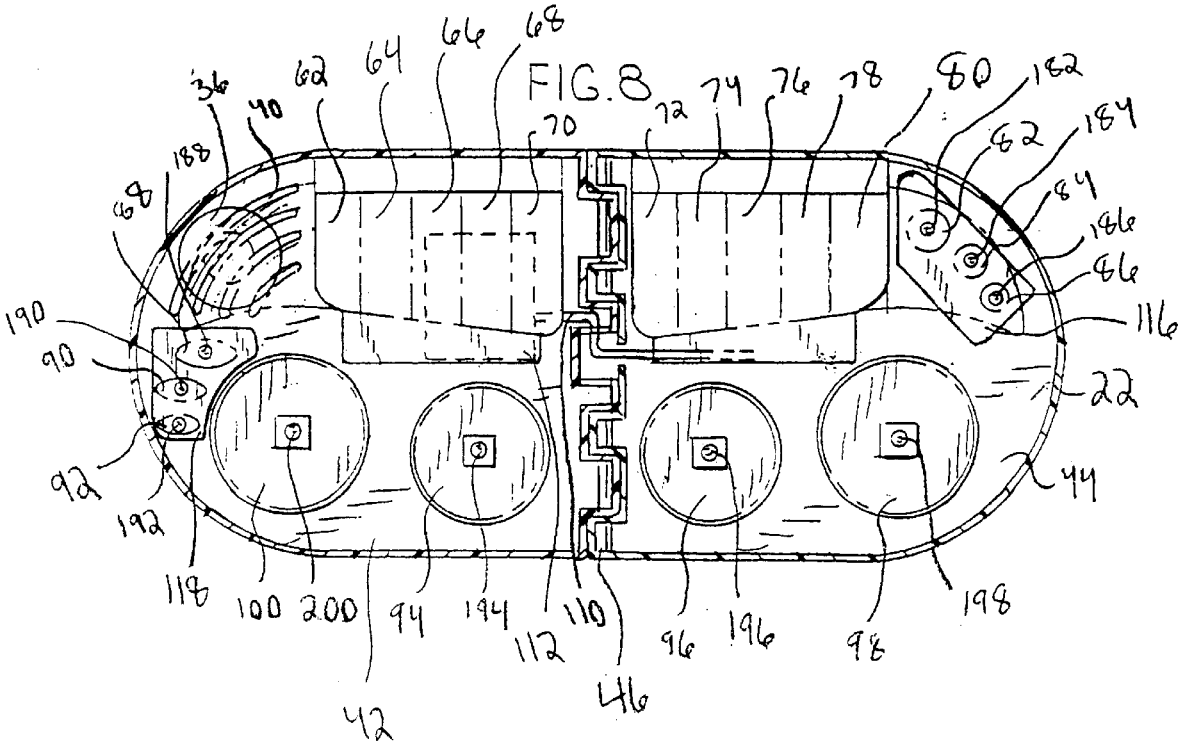
FIG. 8 is a sectional view of the keyboard portion of the musical instrument, taken along line 8—8 of FIG. 6.

As shown in one embodiment of the invention in FIG. 2, the keyboard portion 22 includes keys 62, 64, 66, 68, 70, 72, 74, 76, 78 and 80, each of which can be pressed by a user and corresponds to a different musical note. For example, when the key 62 is pressed, an actuator (not shown) located below the button 62 is actuated, causing a "E" note to be played by the speaker 36 through the keyboard speaker output 40. Larger buttons 94, 96, 98 and 100 are also located on the keyboard portion 22, below which are actuators 194, 196, 198 and 200 as shown in FIG. 8. When one of the buttons, 94, 96, 98 or 100 is pressed and the corresponding actuator is actuated, non-keyboard related sounds can be played, creating a third type of musical instrument. For example, in one embodiment of the invention the pressing of the button 94 results in a sound resembling a sound that would resonate from an ordinary drum. The pressing of the button 96 results in a sound from a set of cymbals. The pressing of the button 98 results in the sound made by a snare drum, and the pressing of the button 100 results in a sound resembling a "cranking" sound. Musical sounds other than those played by a drum set can readily be provided using the buttons 94, 96, 98 and 100.

The keyboard portion 22 also includes a plurality of buttons 82, 84 and 86 with respective corresponding actuators 182, 184 and 186 located thereunder. When the button 82 is pressed, instructions are sent to the internal circuitry (discussed later in detail) to alter the sounds that will be played when the keys 62, 64, 66, 68, 70, 72, 74, 76, 78 and 80 are pressed. In such a case, the resulting sounds resemble those that would come from a standard electronic keyboard. In the event that the button 84 is pressed, the resulting sounds will resemble those that would come from a musical organ. If button 86 is pressed, the resulting sounds resemble those that would come from a xylophone.

Also included on the keyboard portion 22 are an additional series of buttons 88, 90 and 92 with corresponding respective actuators 188, 190 and 192 located thereunder. When one of the buttons 88, 90 or 92 is pressed, a repeating sequence of notes will be played by the speaker 36, each sequence having its own distinct beat. In one embodiment of the invention, if one of the buttons 88, 90 or 92 is pressed and the corresponding actuator 188, 190, 192 is actuated, a particular beat will commence and will continue uninterrupted for either a predetermined amount of time or until that same button is pressed again.

Figure 7:
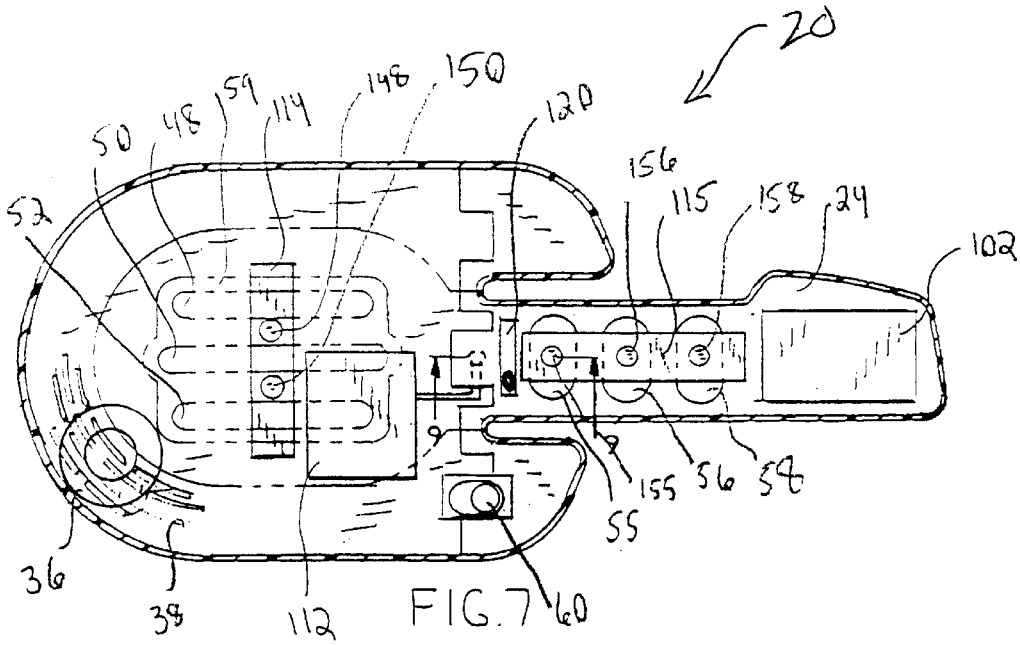
FIG. 7 is a sectional view of the guitar portion of the instrument, taken along line 7—7 of FIG. 6.

As can be seen in FIG. 7, one embodiment of the invention also includes the use of a volume switch 120. Depending upon the relative position of the switch 120, the amount of sound that emanates from the speaker 36 can be adjusted. In one embodiment of the invention, the volume switch 120 only has two positions. It is also possible, however, for the switch to have multiple positions or knobs, levers, or buttons can be used in place of the switch.

Figure 5:
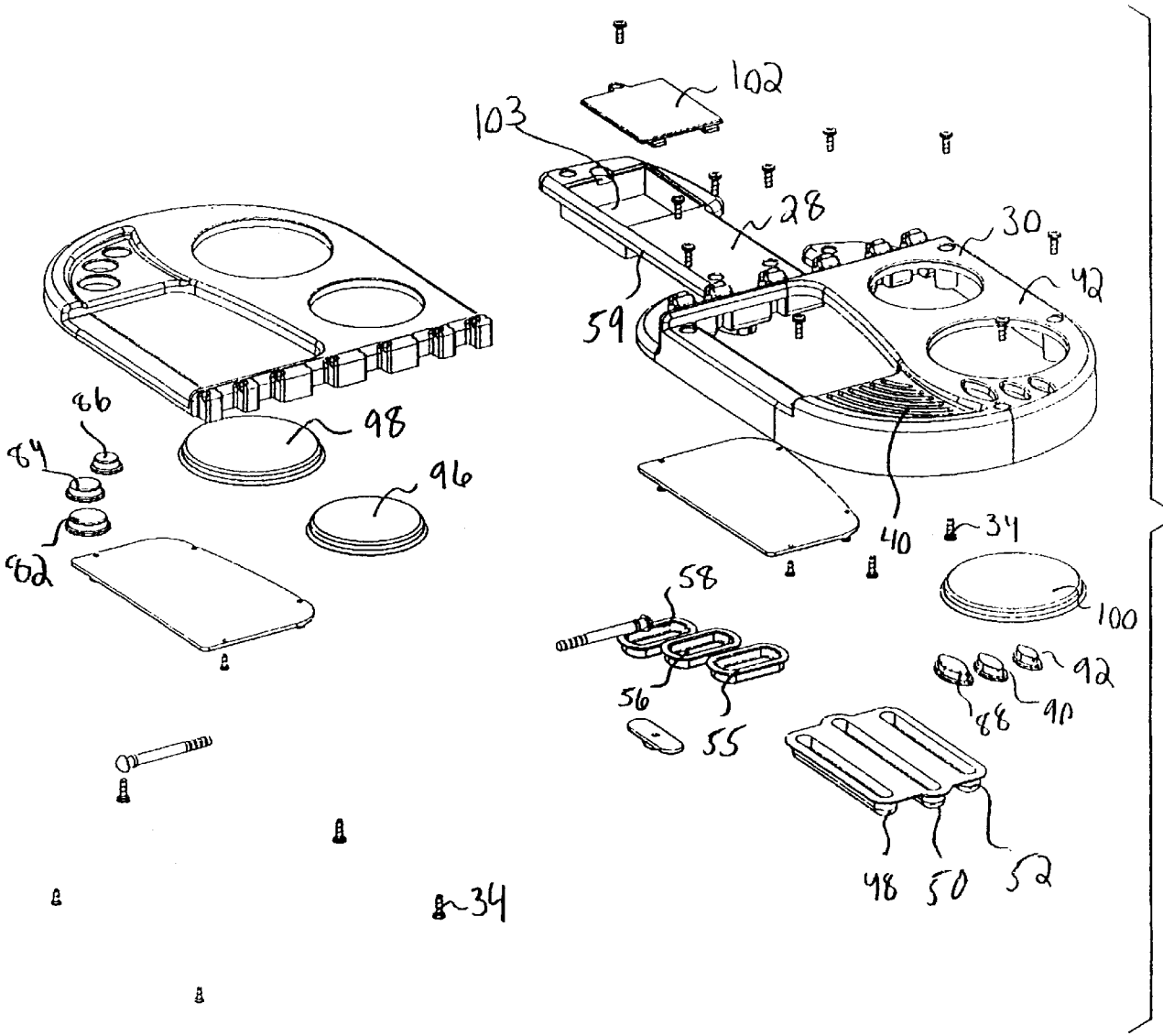
FIG. 5 is another exploded view of the instrument of FIG. 1.

FIGS. 4 and 5 show exploded views of the convertible musical instrument 20. As can be seen in these figures, the guitar portion 24 and the keyboard portion 22 are directly connected to each other by screws 34. The second end 44 of the keyboard portion 22 is coupled to the back side 28 of the guitar portion 24, covering the guitar throat 59 when in the uncollapsed position. Also on the back side 28 of the guitar portion 24 is a battery storage cover 102. The battery storage cover 102 covers a battery region 103 into which a number of batteries (not shown) are placed for supplying power to the instrument 20. According to one embodiment of the invention, three AA batteries supply sufficient power to the instrument 20. Different types and numbers of batteries can also be used in other embodiments to provide power to the instrument 20 depending upon the circuitry and power requirements involved. Furthermore, power can be supplied to the instrument 20 through an electrical cord that can be plugged into a wall outlet or other power source. The first end 42 of the keyboard portion 22 is securely fastened to the guitar portion 24 via a plurality of the screws 34. When the second end 44 of the keyboard portion 22 is rotated about the hinge 46, the first end 42 of the keyboard portion 22 remains stationary relative to the guitar portion 24.

FIGS. 4, 9 and 10 show sectional views of the keyboard hinge 46 when the keyboard portion 22 is in both the uncollapsed and collapsed positions. The first end 42 and the second end 44 are coupled to each other via hinge pins 104 and 105. Not only do the hinge pins 104 and 105 hold the two ends 42 and 44 together, they also serve as the pivot axis for the hinge 46. The hinge pins 104 and 105 pass through a first plurality of projections 106 extending from the first end 42 and a second plurality of projections 108 extending from the second end 44. Running through the hinge 46 and the first and second ends 42 and 44 is a circuit cable 110 (see FIG. 9). The circuit cable 110 permits signals from the second end 44 of the keyboard portion 22 to travel to the other portions of the instrument 20 so that the various sounds can be played by the speaker 36.

The interior of the instrument 20 includes several components of electronic circuitry that work in conjunction with each other to produce the various sounds that resonate from the speaker 36. As can be seen in FIG. 7, the guitar portion 24 includes circuit boards 114 and 115 with the circuit board 114 being coupled to the actuators 148 and 150 and the circuit board 115 being coupled to the actuators 155, 156 and 158. As shown in FIG. 8, the keyboard portion includes circuit boards 116 and 118. The circuit board 116 is coupled to the actuators 182, 184 and 186; and the circuit board 118 is coupled to the actuators 188, 190 and 192. As shown in FIG. 7 included in the center portion of the instrument 20 is a central processing unit 112 which will receive signals from the actuators located throughout the instrument 20.

Figure 11:
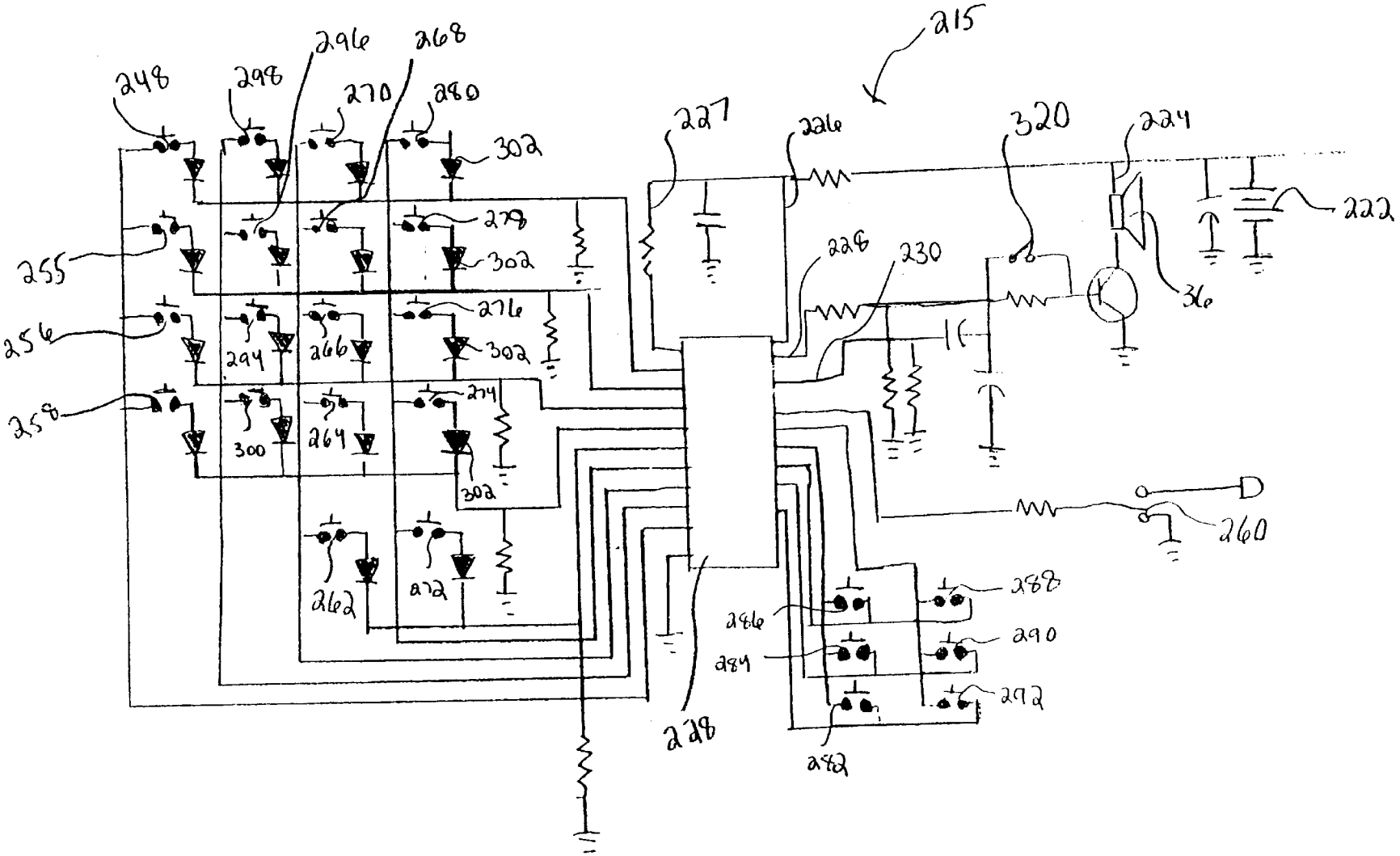
FIG. 11 is an electronic circuit diagram of the electronic components disposed inside the convertible musical instrument.

FIG. 11 shows the circuitry, shown generally at 215, for the convertible musical instrument 20 according to an embodiment of the invention. The operation of the circuitry 200 for the instrument 20 proceeds generally as follows. Power is supplied from the battery source 222 to a microcontroller 228 via connections 226 and 227. Similarly, power is supplied from the battery source 222 to the speaker 36 via connection 224. In one embodiment of the invention, the conventional microcontroller 228 has a product specification number S8050 D-929. Other conventional processors can also be used, however, without departing from the operation of the invention. For each of the keyboard keys 62, 64, 66, 68, 70, 72, 74, 76, 78 and 80 and their respective actuators, there are corresponding connections 262, 264, 266, 268, 270, 272, 274, 276, 278 and 280. Similarly, for the keyboard buttons 82, 84, 86, 88, 90, 92, 94, 96, 98 and 100 there are corresponding connections 282, 284, 286, 288, 290, 292, 294, 296, 298 and 300. For the guitar portion 24, there is one connection 248 for the three guitar buttons 48, 50 and 52, while buttons 55, 56 and 58 each have their own connections 255, 256, 258, respectively. When a particular button or key is actuated, the corresponding connection is closed, sending a signal to the microcontroller 228 which executes a conventional program for performing the desired operation. In many instances the connections are followed by a diode 302 for directing the current flow.

Depending upon the particular connection or connections that are closed, the microcontroller 228 will therefore process the signals, processing sound files (stored inside the microcontroller 228) to be sent to the speaker at 36 via connections 228 and 230. Also in the circuit 215 is a gate 320 that corresponds to the volume control button 120. When the gate 320 is closed, the volume of the sounds played by the speaker 36 will be increased. Corresponding to the mode switch 60 is a separate gate 260. Depending on the relative position of this separate gate 260, instructions will be processed by the microcontroller 228 regarding whether extended sound files or abbreviated sound files should be played when the guitar connection 248 is closed. In this embodiment of the invention, all of the sounds that can eminate from either the guitar portion 24 or the keyboard portion 22 will be stored as .wav files inside the microcontroller 228. It is possible, however, for the sound files to be stored in other formats and/or in a separate ROM unit or similar device. In one embodiment of the invention, the microcontroller 228 stores both .wav files for entire tunes that are played through the guitar portion 24 and individual portions of the same tunes. The particular .wav files that will be played will depend on the relative position of the mode switch 60; if the mode switch 60 is in the position for the playing of an entire tune, then the corresponding .wav files will be processed by the microcontroller 228. Several of the connections corresponding to different keys or buttons can be closed at the same time, and the combination of closed connections ultimately determines the exact .wav file that is played.

While several preferred embodiments have been shown and described in this application, it is understood that changes and modifications can be made to the invention without departing from the invention's broader aspects. For example, a variety of types of microcontrollers or microprocessors could be used in the electronic circuitry of the instrument 20. It is also possible, instead of having a guitar portion 24 and a keyboard portion 22, to have portions that resemble any of several types of instruments, including instruments that are not members of the string or percussion families. It is also possible to have three or more instrument portions in the combination instrument. Regarding the hinge line, one could have individual portions pivot about a single point or use flexible materials that allow individual portions to "bend" about a point or axis. It is possible to store files other than those in the .wav format in the microcontroller or ROM unit. The sound files that are stored can play a variety of sound at different tones, pitches or cadences. Additionally, it is possible to have a different arrangement and/or numbers of keys or buttons on both portions of the instrument 20, and it is also possible to have more than two instrument portions on one toy. Therefore, the present invention is not limited to be described and illustrated embodiment, but only by the scope and spirit of the independent and dependent claims.

What is claimed is:

1. A combination musical instrument, comprising:

a first instrument portion having a front section, a rear section opposite the front section and a plurality of input devices actuable by a user on the front section thereof; and a second instrument portion having a front section, a rear section opposite the front section and a plurality of input devices actuable by a user on the front section thereof, the second instrument portion coupled to the first instrument portion in such a manner as to allow the combination musical instrument to transform from a first instrument to a second instrument.

2. The instrument of claim 1, further comprising an audio output unit, wherein the actuation of at least one of the input devices results in the transmittal of one of a plurality of sounds from the audio output unit.

3. The instrument of claim 1, further comprising a processing unit for storing and transmitting a plurality of sounds to the audio output unit, wherein the actuation of at least one of the input devices results in the transmittal of a signal associated with one of the sounds from the processor to the audio output unit.

4. The instrument of claim 3, wherein the actuation of at least one of the input devices results in the transmittal of a signal characteristic of a preprogrammed sequence of sounds from the processor to the audio output unit.

5. The instrument of claim 1, wherein the second instrument portion includes first and second ends hingedly coupled to each other, the second end capable of being folded over the first end.

6. The instrument of claim 5, wherein when the second end of the second instrument portion is folded over the first end of the second instrument portion, the second instrument portion is concealed from view when the front section of the first instrument portion is in view.

7. The instrument of claim 2, wherein the actuation of at least one of the input devices results in the transmittal of a computer file of a preprogrammed sound that resembles the sound made by a drum.

8. The instrument of claim 2, wherein the actuation of at least one of the input devices results in the transmittal of a computer file of a preprogrammed sound that resembles the sound made by a guitar.

9. The instrument of claim 2, wherein the actuation of at least one of the second plurality of input devices results in the transmittal of a computer file of a preprogrammed sound that resembles the sound made by a keyboard.

10. The instrument of claim 3, further comprising means for altering the sounds transmitted by the audio output unit upon the action of a particular input device.

11. A toy instrument, comprising:

a guitar portion including a first plurality of input buttons; and a keyboard portion including a second plurality of input buttons, wherein the guitar portion and the keyboard portion are coupled to each other, the actuation of one of the input buttons on the guitar or keyboard portions resulting in the transmittal of a signal characteristic of at least one of a plurality of preprogrammed sounds, the guitar portion and the keyboard portion including anterior and posterior sides, the posterior side of the guitar portion connected to the posterior side of the keyboard portion.

12. The toy instrument of claim 11, wherein the guitar portion and the keyboard portion are hingedly coupled to each other.

13. The toy instrument of claim 12, further comprising means for collapsing the keyboard portion, substantially enclosing the second plurality of input buttons.

14. The toy instrument of claim 11, further comprising means for storing a plurality of signals, wherein each input button corresponds to at least one signal in said storage means.

15. The toy instrument of claim 14, further comprising an output unit coupled to said storage means, the output unit transmitting signals from said storage means upon the actuation of a particular input button.

16. The toy instrument of claim 15, wherein said storage means store a plurality of audio signals, at least one of the audio signals transmitted by the output unit upon the actuation of a particular input button.

17. A combination toy instrument, comprising:

a first toy instrument including a first plurality of input devices for actuation by a user on a first side thereof;

a second toy instrument coupled to the first toy instrument including a second plurality of input devices for actuation by a user on a first side thereof;

means for storing a plurality of preprogrammed sounds, each of the preprogrammed sounds corresponding to a particular input device; and means for transmitting the plurality of sounds upon the actuation of the corresponding input device, wherein the first and second toy instruments are coupled to each other along the sides opposite the first and second pluralities of input devices portion in such a manner as to allow the toy instrument to transform in shape.

18. The instrument of claim 17, further comprising a third toy instrument including a third plurality of input devices for actuation by a user, the third toy instrument coupled to the first toy instrument.

19. The instrument of claim 18, wherein the second instrument is foldable about an axis, concealing the second plurality of input devices.

20. The instrument of claim 17, further comprising an audio output unit, wherein the actuation of at least one of the input devices results in the transmittal of one of a plurality of sounds from the audio output unit.

* * * * *